US011365074B2

(12) United States Patent
Huang et al.

(10) Patent No.: US 11,365,074 B2
(45) Date of Patent: Jun. 21, 2022

(54) TRAY COVER EXTENDERS

(71) Applicant: Hewlett-Packard Development Company, L.P., Spring, TX (US)

(72) Inventors: Xiaoxi Huang, Singapore (SG); Deming Xu, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 170 days.

(21) Appl. No.: 16/634,965

(22) PCT Filed: Jul. 31, 2017

(86) PCT No.: PCT/US2017/044689
§ 371 (c)(1),
(2) Date: Jan. 29, 2020

(87) PCT Pub. No.: WO2019/027424
PCT Pub. Date: Feb. 7, 2019

(65) Prior Publication Data
US 2020/0239247 A1 Jul. 30, 2020

(51) Int. Cl.
*B65H 1/04* (2006.01)

(52) U.S. Cl.
CPC ..... *B65H 1/04* (2013.01); *B65H 2403/41* (2013.01); *B65H 2405/115* (2013.01); *B65H 2405/1122* (2013.01); *B65H 2405/11164* (2013.01)

(58) Field of Classification Search
CPC .... B65H 2403/411; B65H 2405/11164; B65H 2405/115; B65H 2405/1122
See application file for complete search history.

(56) References Cited

U.S. PATENT DOCUMENTS 5,127,646 A * 7/1992 Matsuda ..... B65H 3/0833 271/171
5,425,577 A 6/1995 Gembler
7,365,991 B2 4/2008 Aldrich
7,553,099 B2 6/2009 Bandou et al.
(Continued)

FOREIGN PATENT DOCUMENTS

CN 203195018 U 9/2013
JP 2003192152 A 7/2003
(Continued)

OTHER PUBLICATIONS

Webpage~Load Paper in the Paper Tray, Jan. 29, 2013~11 pages http://support.brother.com/.

*Primary Examiner* — Howard J Sanders
(74) *Attorney, Agent, or Firm* — Brooks Cameron & Huebsch PLLC

(57) ABSTRACT

In an example, a tray cover extender may include a cover rack attached to a movable tray cover such that movement of the cover rack is transferred to a movement of the movable tray cover. Further, the tray cover extender may include a pinion gear operably engaged with the cover rack so as to actuate or move the cover rack if the pinion gear is actuated. The example tray cover extender may also include a tray rack attached to a media tray. The tray rack may actuate or move the pinion gear as the media tray is moved past the pinion gear. The cover rack may extend the movable tray cover from a first position to a second position if the pinion gear actuates the cover rack.

15 Claims, 6 Drawing Sheets

(56) References Cited

U.S. PATENT DOCUMENTS

| | | | | |
|---|---|---|---|---|
| 7,677,548 | B2 * | 3/2010 | Chino | B65H 3/0684 271/164 |
| 7,704,000 | B2 | 4/2010 | Bryant et al. | |
| 7,815,267 | B1 | 10/2010 | Frousiakis | |
| 8,641,032 | B2 * | 2/2014 | Nakamura | B41J 13/106 271/9.05 |
| 2008/0240835 | A1 | 10/2008 | Triplett et al. | |
| 2012/0195669 | A1 * | 8/2012 | Nakamura | B65H 31/22 400/578 |
| 2021/0155021 | A1 * | 5/2021 | Iwata | B65H 31/02 |

FOREIGN PATENT DOCUMENTS

| | | | | |
|---|---|---|---|---|
| JP | 2012046302 | A | 3/2012 | |
| JP | 5736781 | B2 * | 6/2015 | B65H 1/266 |
| RU | 2290577 | C2 | 12/2006 | |
| RU | 2549217 | C2 | 4/2015 | |

* cited by examiner

TRAY COVER EXTENDERS

BACKGROUND

Electronic devices such as imaging devices, for example, may perform operations on or with media, sometimes referred to as print media. Such media may be loaded into the electronic device so as to ready the media for such operations. Electronic devices may include an input tray to receive media. In some situations, electronic devices may be able to perform operations on or with media of varying lengths or sizes, and, as such, an input tray of the electronic device may be able to receive and hold multiple sizes of media.

DETAILED DESCRIPTION

Figure 1:
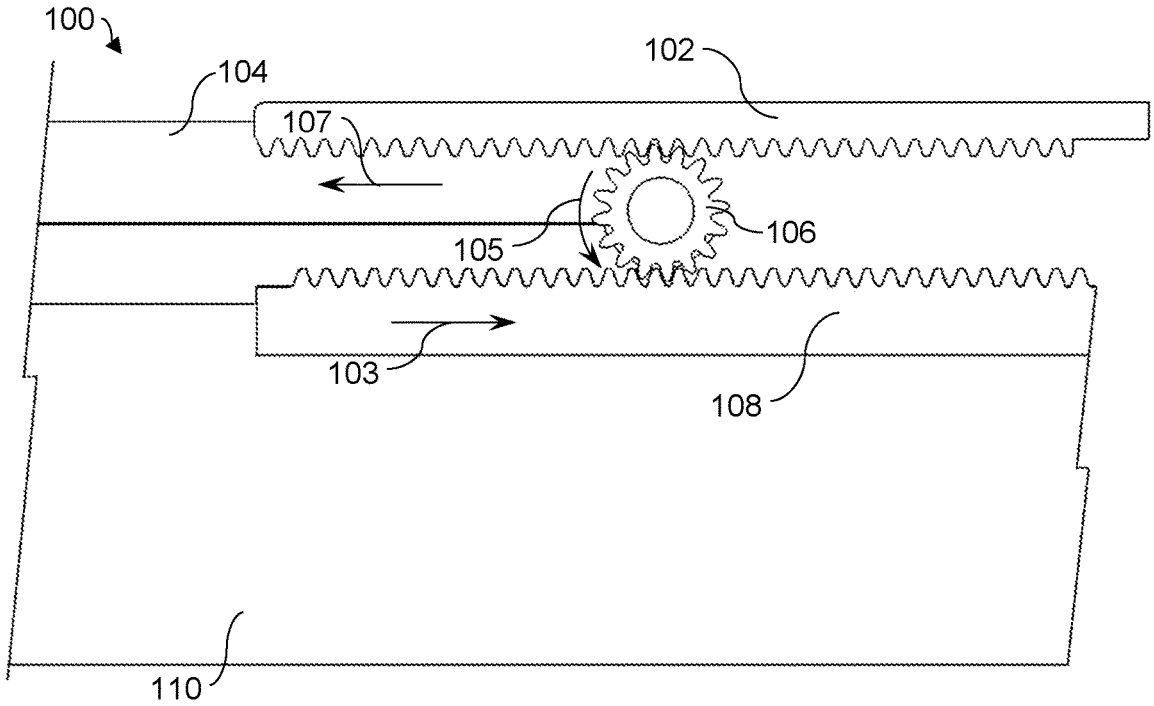
FIG. 1 is a side view of an example tray cover extender.

Electronic devices such as imaging devices, for example, may perform operations on or with media, sometimes referred to as print media, or a medium thereof. Such operations may include printing, copying, scanning, plotting, or other types of operations using media. Such media, therefore, may be loaded into the electronic device so as to ready the media for such operations. Electronic devices may include an input tray to receive and hold media prior to performing operations on or with the media. In some situations, electronic devices may be able to perform operations on or with media of varying lengths or sizes, and, as such, an input tray of the electronic device may be able to receive and hold multiple sizes of media. In some situations, an input tray may be able to be extended to accommodate media of different lengths.

In some situations, it may be desirable to have a cover or lid disposed on or extending over an input tray of an electronic device. Such cover may protect the input tray, and media disposed within the tray, from dust, dirt, or other environmental contaminants, and prevent such contaminants from making its way further into the electronic device, possibly causing a malfunction or compromising the quality of the operations performed by the electronic device. Additionally, a cover on the input tray may prevent a user from trying to load media directly into the tray or the electronic device while the tray is loaded into the electronic device. Such an improper loading of media may cause media jams or other malfunctions. Further, a cover on the input tray may provide positive aesthetic qualities to the electronic device.

In some situations, the input tray may be extendable from a first position to receive media of a first size, to a second position to receive media of a second, different size. Such an adjustable or extendable nature of the input tray may prevent a cover for the input tray from properly covering and/or protecting the input tray when the input tray is disposed in the second, often longer, position to receive larger media, since the cover may be sized to conceal or cover the input tray in the first, often shorter, position. There may exist a gap or opening between the cover and a portion of the input tray, exposing media to the environment, and also having a negative aesthetic quality.

In some situations, a cover for the input tray may itself be convertible or extendable to protect the input tray across multiple sizes. Often this means a user of the electronic device may remove the cover, manually extend or change the orientation of the cover, then reattach the cover to the input tray. Such a removable cover may be easily lost, may interfere with the operation of the electronic device if not attached or extended properly, and/or may be confusing or difficult for a user to adjust manually. Further, such a convertible cover may not have as positive of an aesthetic quality as a fixed, single-size cover. Therefore, it may be desirable in some situations to have an input tray cover that may automatically extend and/or retract to cover or conceal the input tray when the input tray is disposed in different positions to accommodate different sizes and/or types of media.

Implementations of the present disclosure provide tray cover extenders that may be used to automatically extend and/or retract tray covers for input trays of electronic devices. Example tray cover extenders disclosed herein may function without the assistance of a user, and may be integrally disposed within an electronic device, lessening the likelihood of loss, malfunction, interference with the function of the electronic device, and/or providing a positive aesthetic quality to the electronic device.

Referring now to FIG. 1, a side view of an example tray cover extender 100 is illustrated. Tray cover extender 100 may include a cover rack 102 attached to or engaged with a movable tray cover 104 such that movement of the cover rack 102 is transferred to a movement of the movable tray cover 104. The tray cover 104 may be a component to cover or conceal a media tray so as to protect the media tray or isolate an inner compartment or media holding portion of the media tray from the environment. Further, tray cover extender 100 may include a pinion gear 106 operably engaged with the cover rack 102 so as to actuate or move the cover rack 102 if the pinion gear 106 is actuated (i.e., caused to move). Example tray cover extender 100 may also include a tray rack 108 attached or fixed to a media tray 110, sometimes referred to as an input tray. The media tray may receive and hold media, sometimes referred to as print media, for use in an electronic device. In some implementations, the media tray 110 may receive and hold the media in a stacked or ream fashion. The tray rack 108 may be operably engaged with the pinion gear 106 so as to actuate or move the pinion gear 106 as the media tray 110 is moved past the pinion gear 106. Additionally, the cover rack 102 may extend the movable tray cover 104 from a first position to a second position if the pinion gear 106 actuates the cover rack 102.

Referring still to FIG. 1, an example movement of the tray cover extender 100 is illustrated. Media tray 110, and thus tray rack 108, may be moved along or past the pinion gear 106, for example along direction 103. The tray rack 108 may be operably engaged with the pinion gear 106 such that such a movement along direction 103 may actuate the pinion gear 106 and cause the pinion gear 106 to rotate in a corresponding direction 105. The pinion gear 106 may be operably engaged with the cover rack 102 such that such an actuation or movement of the pinion gear 106 may cause the cover rack 102 to move along a corresponding direction 107. Finally, the cover rack 102 may be engaged with or sufficiently attached to the movable tray cover 104 such that such a movement of the cover rack 102 may cause the tray cover 104 to move along the direction 107 from a first position to a second position. In some implementations, the direction 103 and the direction 107 may be opposite to one another.

Although illustrated as gears or cogs having complementary teeth to mesh together to transfer motion or force to one another, it is contemplated that the cover rack 102, the pinion gear 106, and the tray rack 108 may be other types of components that may be suitable for transmitting motion or force. For example, the pinion gear 106 may be a friction wheel having a high coefficient of friction, and the cover rack 102 and/or the tray rack 108 may be high-friction surfaces, also having high coefficients of friction. In other implementations, the tray rack 108, the pinion gear 106, and the cover rack 102 may have a double rack and pinion structure. In some implementations, the cover rack 102 and/or the tray rack 108 may not be directly engaged with the pinion gear 106, but instead may have intermediary components indirectly connecting the cover rack 102 and the tray rack 108 to the pinion gear 106. Such intermediary components may include belts, chains, pulleys, wheels, or other transmission components.

Figure 2A:
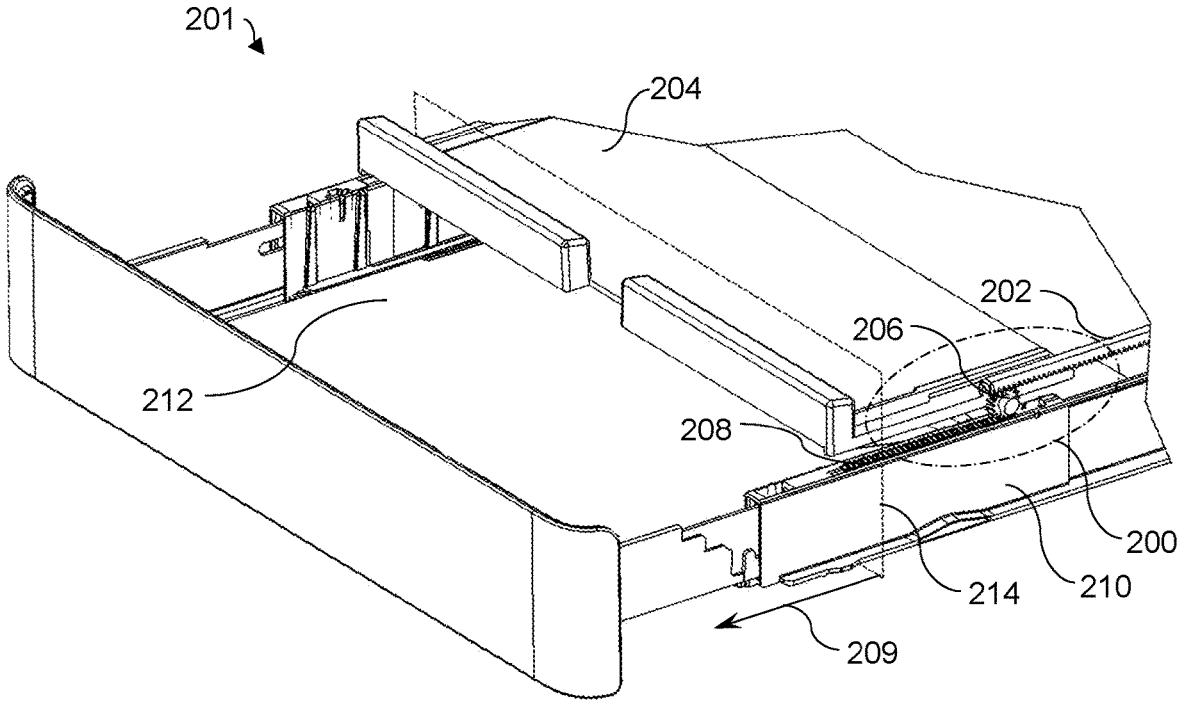
FIG. 2A is a perspective view of an example media tray having an example tray cover extender.

Referring now to FIG. 2A, a perspective view of an example media tray 201 having an example tray cover extender 200 is illustrated. Example tray cover extender 200 may be similar to other example tray cover extenders described above, e.g., tray cover extender 100. Further, the similarly-named elements of example tray cover extender 200 may be similar in function and/or structure to the respective elements of other example tray cover extenders, as they are described above. Example media tray 201 is illustrated in FIG. 2A as being, at least partially, unloaded or removed from an input tray bay or opening 214 of an electronic device. For example, the media tray 201 may have been pulled out of the input tray bay 214 along example direction 209.

Example media tray 201 may be similar to media tray 110, and may include a media holding portion 212 to receive and hold media. In some situations, the media tray 201, or the media holding portion 212 thereof, may be convertible or extendable, or otherwise movable, between a first position, to accommodate (i.e., to receive and hold) media having a first length or size, and a second position, to accommodate media having a second length or size. Stated differently, the media holding portion 212 may be sized to hold media of a first length if disposed in the first position, and may further be sized to hold media of a second length (which may be longer than the first length, in some implementations) if disposed in the second position. FIG. 2A illustrates the media holding portion 212 as being disposed in the second position. In some implementations, media having the second size may be longer than media having the first size, and thus, the media holding portion 212 may be expanded to transition from the first position to the second position. In some implementations, the media holding portion 212 may be defined by a media housing 210, which may be a casing, housing, or other structure forming the media holding portion 212. The media housing 210 may structurally support the ability of the media holding portion 212 to transition between the first position and the second position.

In some implementations, the media tray 201 may include a tray cover 204 which may be movable or slidable between a retracted position and an extended position. FIG. 2A illustrates the tray cover 204 as being disposed in the retracted position. When the tray cover 204 is disposed in the retracted position, the tray cover 204 may be sized sufficiently to cover and/or conceal a top portion or a loading side of the media holding portion 212 if the media holding portion 212 is disposed in the first position to accommodate media having the first size. The loading side or top portion of the media holding portion 212 may refer to a side of the media housing 210 which may be open and able to receive media in order to load the media into the media holding portion 212. Since the example media tray, or the media holding portion 212 thereof, is illustrated in FIG. 2A as being disposed in the second position, the tray cover 204 would not fully cover or conceal the loading side of the media holding portion 212 if the media tray 201 were to be loaded back into the input tray bay or opening 214 of the electronic device. Thus, media disposed within the media holding portion 212 would be exposed, at least partially, to the environment.

Figure 2B:
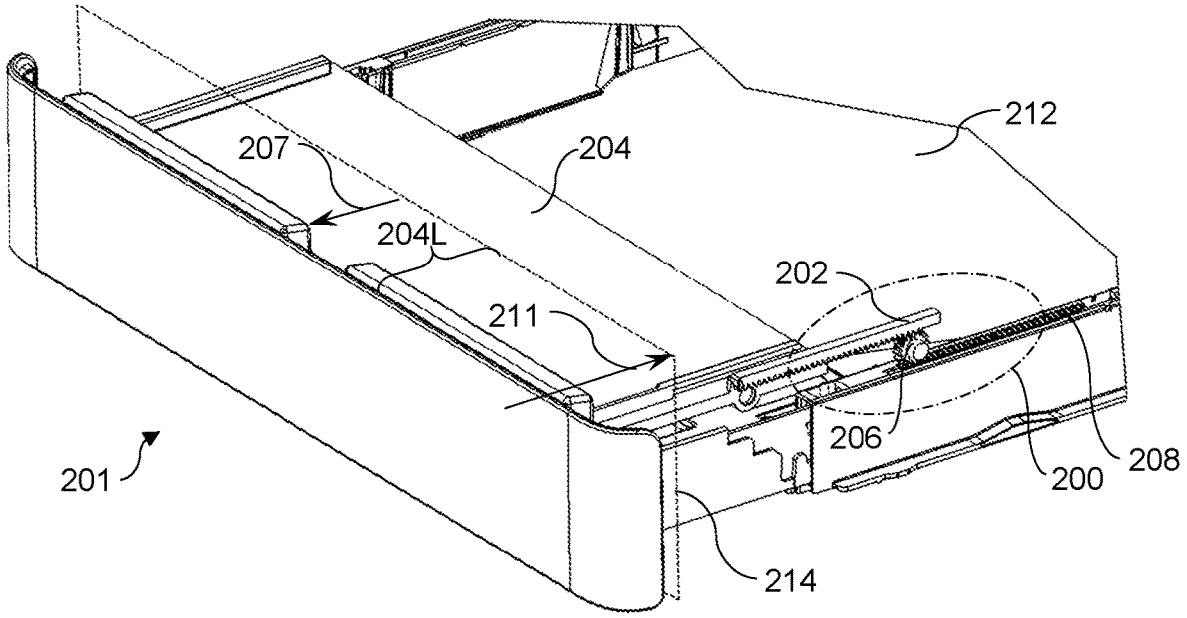
FIG. 2B is a perspective view of an example media tray having an example tray cover extender.

Referring now to FIG. 2B, a perspective view of example media tray 201 having the example tray cover extender 200 is illustrated, wherein the media tray 201 has been fully loaded or inserted, for example along direction 211, into the input tray bay 214 of the electronic device. In the illustrated example, the tray cover extender 200 has transitioned the tray cover 204 from the retracted position to the extended position, for example along direction 207. In other words, as the media tray 201 was inserted into the input tray bay 214, the media holding portion 212, and a tray rack 208 attached thereto, has moved past or along a pinion gear 206. The pinion gear 206 has transferred such a motion of the tray rack 208 into an opposite motion of a cover rack 202, attached or fixed to the tray cover 204, thereby pushing or moving the tray cover 204 along direction 207 from the retracted position to the extended position. The tray cover 204 has moved a distance 204L to cover an additional portion of the media holding portion 212 so as to protect and/or isolate the media holding portion 212, and any media disposed within, from the outside environment. Stated yet differently, when disposed in the retracted position, the tray cover 204 may cover or conceal a first portion of the loading side of the media holding portion 212, and when disposed in the extended position, the tray cover 204 may cover or conceal a second portion of the loading side, which may be larger than the first portion. In the illustrated example, the second portion of the loading side may be approximately equal to the first portion of the loading side, plus the extra distance 204L that the tray cover 204 has moved.

Figure 3A:
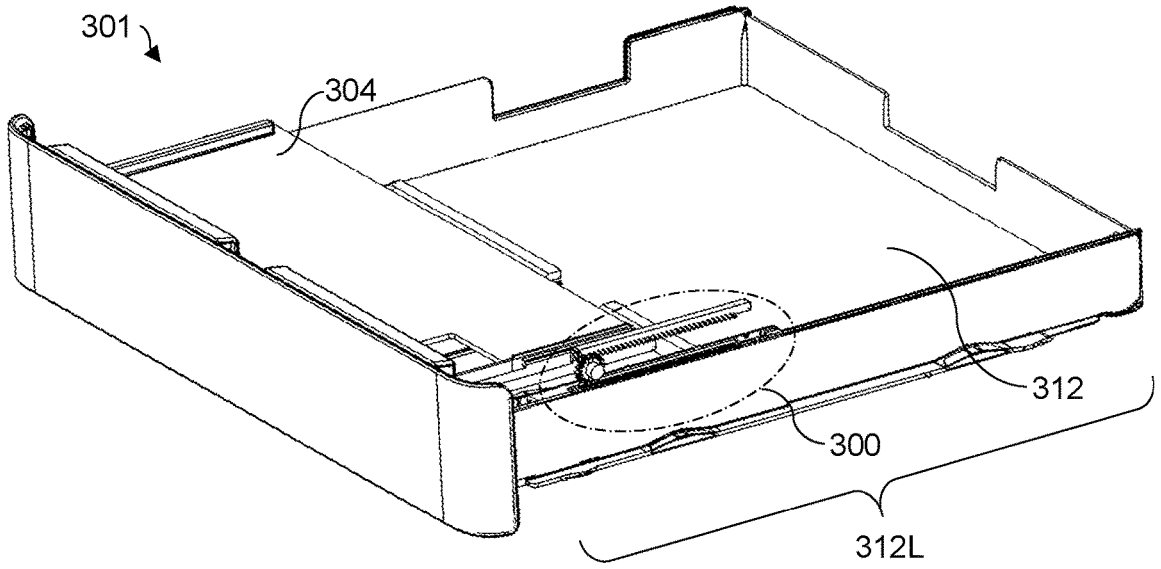
FIG. 3A is a perspective view of an example media tray having an example tray cover extender.

Referring now to FIG. 3A, a perspective view of an example media tray 301 having an example tray cover extender 300 is illustrated. Example tray cover extender 300 may be similar to other example tray cover extenders described above, e.g., tray cover extender 100 and/or 200. Further, the similarly-named elements of example tray cover extender 300 may be similar in function and/or structure to the respective elements of other example tray cover extenders, as they are described above. The example media tray 301 may have a media holding portion 312, which may be movable between a first position (illustrated in FIG. 3A), and a second position (illustrated in FIGS. 3D-3E and discussed below). When disposed in the first position as shown, the media holding portion may have a length of 312L and, thus, may be able to accommodate media with a corresponding length. The media holding portion 312 may also have a loading side which, in this illustration, might be an open top side of the media holding portion 312. The media tray 301 may also have a tray cover 304, illustrated as being disposed in a retracted position, covering or concealing a first portion of the loading side in FIG. 3A. It should be noted that the tray cover 304, along with a cover rack and a pinion gear of the tray cover extender 300, may be attached to, or may be considered to be a part of an electronic device within which or with which the media tray 301 may be loaded or engaged. Thus, the media tray 301, or the media holding portion 312 thereof, may be able to be slid or moved relative to the tray cover 304, for example, if the media tray 301, or the media holding portion 312 thereof, is being pulled to an opened position out of an input tray bay of the electronic device. Further, it should be noted that, although the media tray 301 is illustrated as having a single tray cover extender 300, it is contemplated that some implementations may include a second tray cover extender disposed on an opposing side of the media holding portion 312.

Figure 3B:
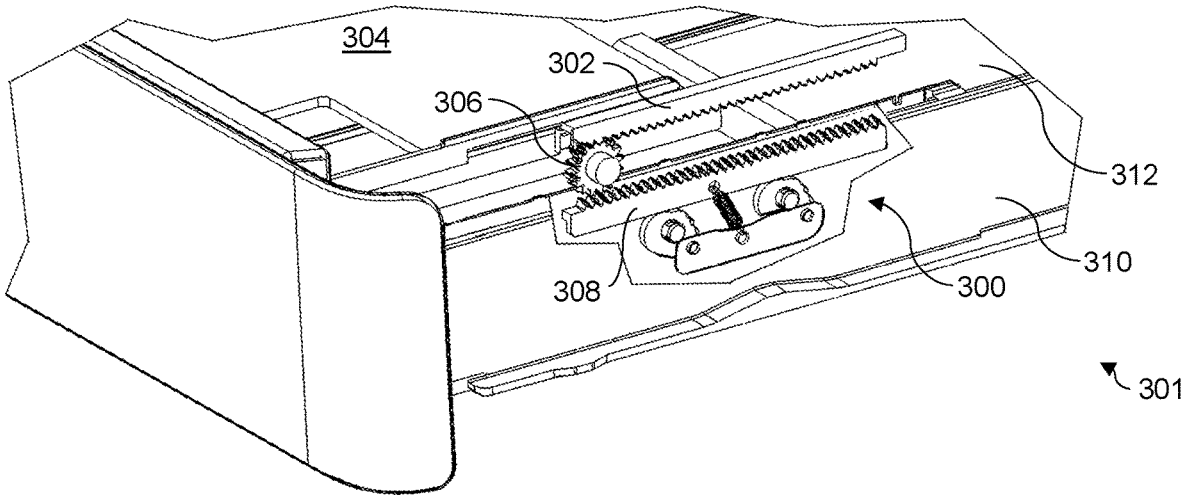
FIG. 3B is a detail perspective view of an example media tray having an example tray cover extender.

Referring now to FIG. 3B, a detail cutaway perspective view of the example media tray 301 and the tray cover extender 300 thereof is illustrated. Note, the media holding portion 312 may have or may be defined by a media housing 310. The media housing 310 is illustrated as being partially cutaway to show the tray cover extender 300, which may be disposed behind or hidden inside the media housing 310, in some implementations. Example tray cover extender may have a cover rack 302, a tray rack 308, and a pinion gear 306. The pinion gear 306 may be operably engaged with the cover rack 302, but, as illustrated in FIG. 3B, the pinion gear 306 may not be operably engaged with (i.e., may be spaced apart from) the tray rack 308.

Figure 3C:
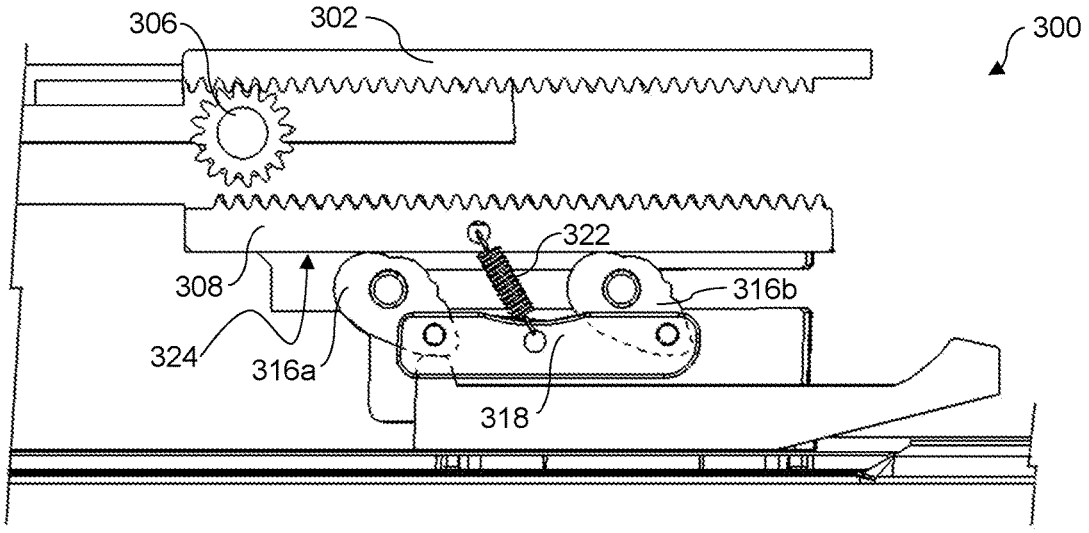
FIG. 3C is a side view of an example media tray having an example tray cover extender.

Referring additionally to FIG. 3C, a side view of the example tray cover extender 300 is illustrated. The tray rack 308 may be attached to the media tray 301, or the media holding portion 312 or media housing 310 thereof, and may be movable between a lowered position and a raised position. The tray rack 308 is illustrated as being disposed in the lowered position in FIG. 3C. As such, and as mentioned above, in the current state of the tray cover extender 300, the pinion gear 306 may be spaced apart from the tray rack 308. Thus, movement of the media holding portion 312, and thus the tray rack 308, along or past the pinion gear 306 may not move or actuate the pinion gear 306. In other words, the media tray 301 may be pulled out of and loaded into an input bay of an electronic device, relative to the pinion gear 306 and the cover rack 302, and the tray cover extender 300 may not be actuated.

In some implementations, the tray cover extender 300 may further include a first cam 316*a* and a second cam 316*b* (which may be referred to collectively as cams 316). The tray rack 308 may be movable and may have a bottom surface 324, which may rest on cam surfaces of the first cam 316*a* and the second cam 316*b*. Further, the first cam 316*a* and the second cam 316*b* may be connected to each other by a tie bar 318 so that movement of one of the first cam 316*a* or the second cam 316*b* will be transferred into corresponding movement of the other. Note, in some implementations, the tray cover extender 300 may only have a single cam 316 upon which the tray rack 308 may rest.

Figure 3D:
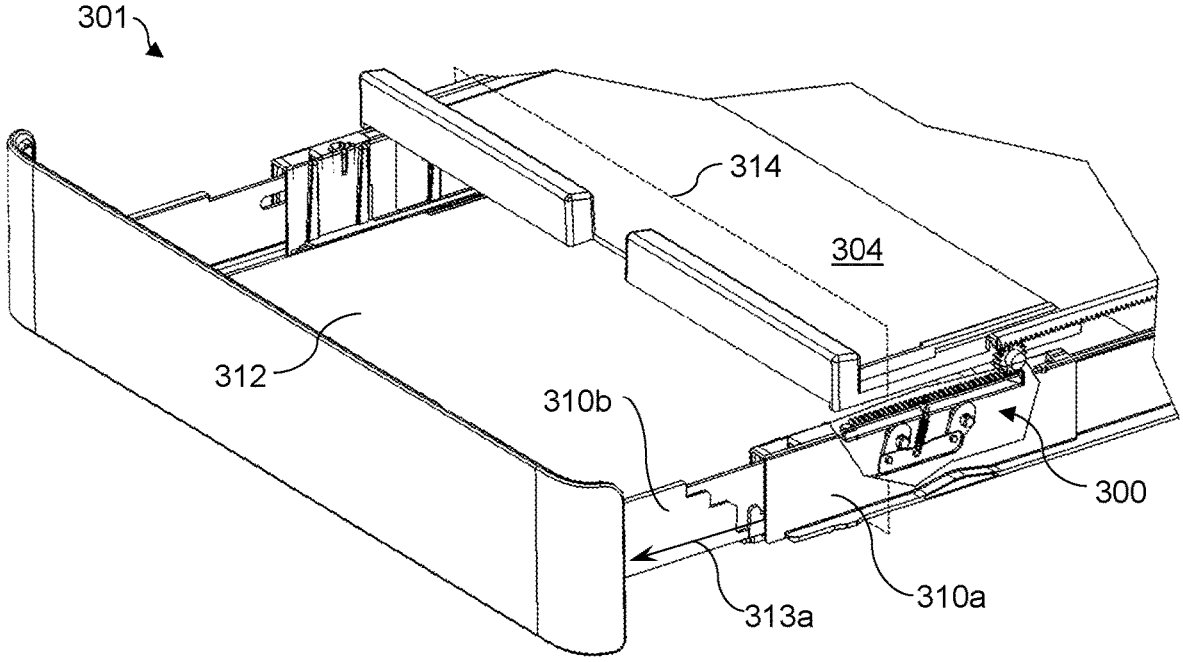
FIG. 3D is a perspective view of an example media tray having an example tray cover extender.

Referring now to FIG. 3D, a perspective view of the example media tray 301 is illustrated wherein the media tray 301 has been pulled out or unloaded (at least partially) from an input tray bay 314 of an electronic device with which the media tray 301 is engaged. Further, the tray cover 304 may be illustrated as still being disposed in the retracted position. The media tray 301, or the media holding portion 312 thereof, is illustrated as having been transitioned from the first position to the second position. Thus, the media holding portion 312 may now have a length greater than 312L, and, thus, may be able to accommodate media having a correspondingly greater length. The media housing 310 may have a first housing portion 310*a* and a second housing portion 310*b*. In some implementations, the second housing portion 310*b* may be at least partially disposed within the first housing portion 310*a* and movable relative thereto, such that the second housing portion 310*b* may be able to be pulled out of the first housing portion 310*a* so as to structurally support the transition of the media holding portion 312 from the first position to the second position. In other words, the second housing portion 310*b* may be able to be moved, at least partially, along example direction 313*a* in order to increase the length of the media holding portion 312 to transition the media holding portion 312 to the second position.

Figure 3E:
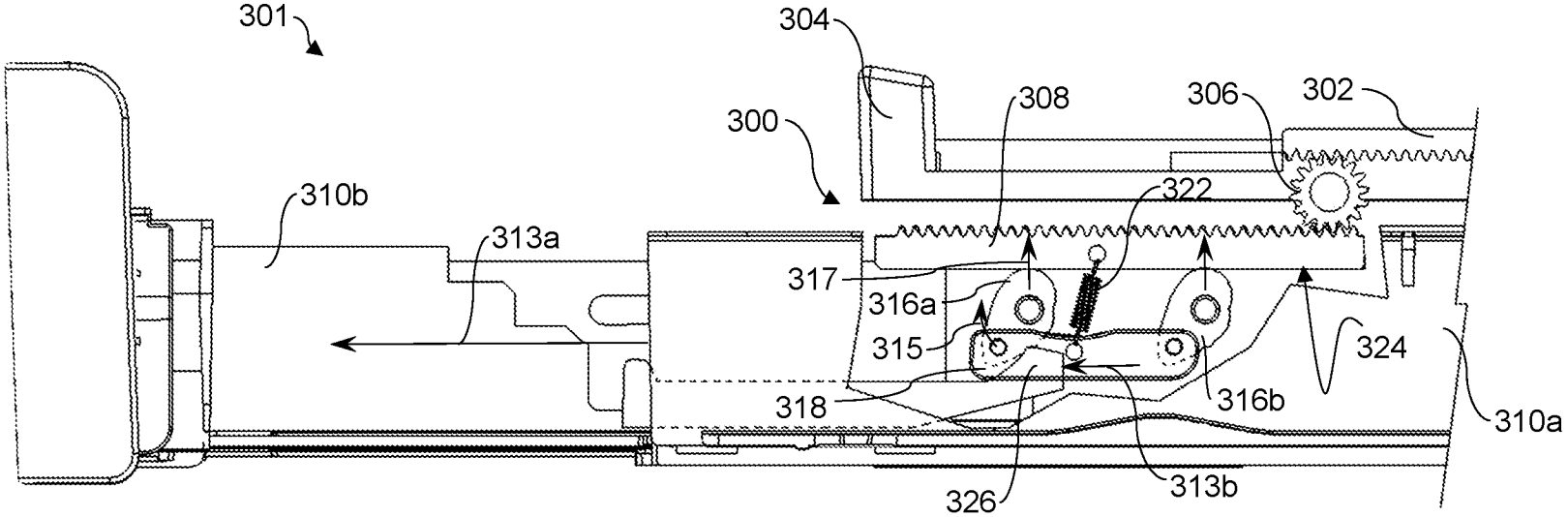
FIG. 3E is a side view of an example media tray having an example tray cover extender.

Referring additionally to FIG. 3E, a side view of the example media tray 301 is illustrated wherein the media tray 301, and/or the media holding portion 312 thereof, is disposed in the second position. In further implementations, the tray cover extender 300 may further include a trigger 326 attached to or engaged with the second housing portion 310*b* such that the trigger 326 moves with the second housing portion 310*b*. Throughout the movement of the second housing portion 310*b* along direction 313*a*, the trigger 326 has moved in a similar fashion and actuated the cams 316. Specifically, the trigger 326 has moved along direction 313*b* to push or urge the first cam 316*a* to rotate, for example, along direction 315. The first cam 316*a* has thus pulled or otherwise moved the tie bar 318 so as to cause the tie bar 318 to move or rotate the second cam 316*b* in a similar fashion to that of the first cam 316*a*. The rotational movement of the cams 316 has caused the cam surfaces of the cams 316 to push or otherwise exert a force on the tray rack 308, and/or the bottom surface 324 thereof, in an upward direction 317 in order to transition the tray rack 308 from the lowered position to the raised position. Thus, the tray rack 308 is to transition from the lowered position to the raised position if the media holding portion 312 is moved from the first position to the second position. Therefore, as illustrated in FIG. 3E, the tray rack 308 is disposed in the raised position such that the tray rack 308 is operably engaged with the pinion gear 306. It should be noted that, in other implementations, the trigger 326 may push, pull, or otherwise urge the cams 316 to move in a different fashion to exert an upward force 317 on the tray rack 308 in order to transition the tray rack 308 to the raised position. Once the tray rack 308 is disposed in the raised position, the tray cover extender 300 may move the tray cover 304 to the extended position to cover or conceal the media tray 301 in a similar fashion to as described regarding FIGS. 2A-2B. In other words, the act of pushing the media tray 301 back into a loaded position with the input tray bay 314 may move the tray rack 308 along or past the pinion gear 306 such that the tray rack 308 actuates or moves the pinion gear 306, which, in turn, actuates or moves the cover rack 302 in order to transition the tray cover 304 from the retracted position to the extended position. The tray cover 304 may cover or conceal a second portion of the loading side when disposed in the extended position. Further, pulling the media tray 301 back out of the input tray bay 314 may transition the tray cover 304 from the extended position back to the retracted position through a reversal of the above-described functions.

In some implementations, the trigger 326 may continuously exert a force on the cams 316 in order to maintain the tray rack 308 in the raised position. Thus, in order to return the tray rack 308 to the lowered position, the second housing portion 310*b* may be pushed or moved in a direction opposite to 313*a* so as to move the trigger 326 away from the cams 316. In further implementations, the tray cover extender 300 may further include a bias member 322 to urge the tray rack 308 back towards the lowered position. The bias member 322 may be a resilient component that is capable of returning to its original shape after undergoing a deformation. In other words, the bias member 322 may be elastically deformable. In some implementations, the bias member 322 may be a spring, and in further implementations, the bias member 322 may be a tension spring and structured so as to pull the tray rack 308 towards the tie bar 318. In other implementations, the bias member 322 may be another type of spring and/or oriented in another manner sufficient to exert a force on the tray rack 308 towards the lowered position.

Thus, in order to accommodate larger media, the media tray 301 may be pulled out of the input tray bay 314, and may be extended to a larger tray. The act of extending the tray may activate the tray cover extender 300 such that the tray cover extender 300 extends the tray cover 304 to cover or conceal the additional length of the media tray 301 during loading or inserting the media tray 301 back into the input tray bay 314.

It should be noted that, while the above description and associated figures depict the tray rack as movable between a lowered and raised position, it is also contemplated that other implementations may include a cover rack that is movable between a lowered and raised position, with the tray rack being attached to the media tray in a fixed position. In such an implementation, the cover rack may operably engage with the pinion gear when disposed in the lowered position, and may not operably engage with the pinion gear if disposed in the raised position.

Figure 4A:
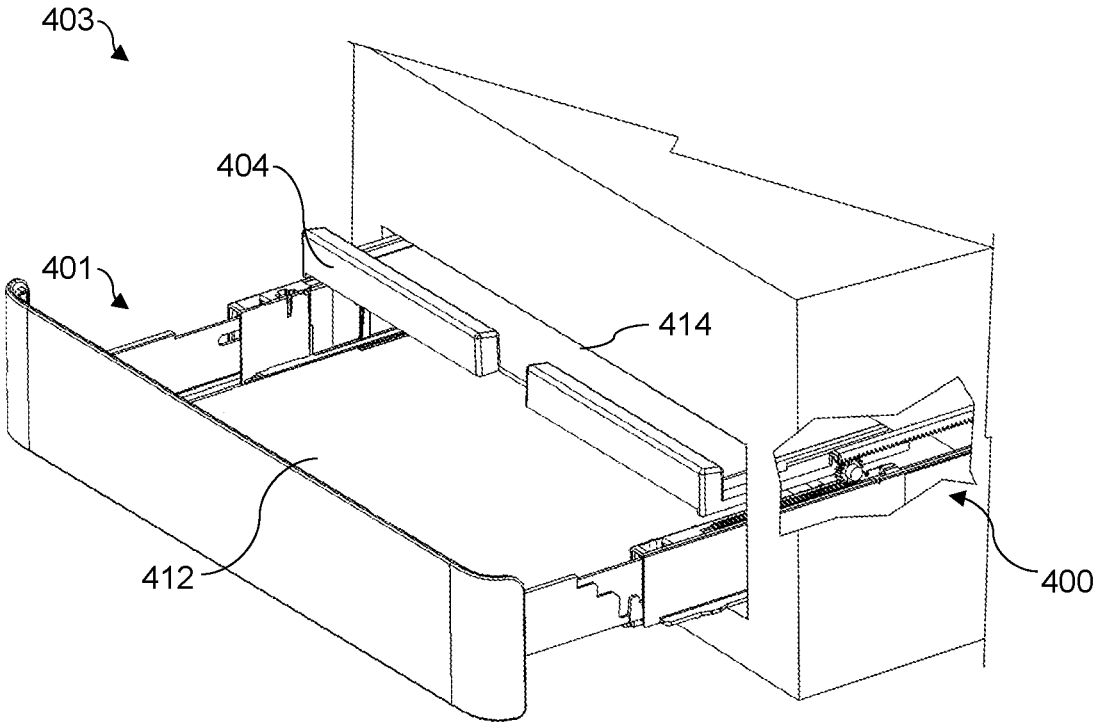
FIG. 4A is a perspective view of an example imaging device having an example tray cover extender.

Referring now to FIG. 4A, an example electronic device 403 having an example tray cover extender 400 is illustrated. In some implementations, the electronic device 403 may be an imaging device. Such imaging device may be a printer, scanner, copier, plotter, all-in-one multifunction imaging device, or another type of device. In other implementations, the electronic device 403 may be another type of device that may benefit from having a media tray with a tray cover. The electronic device may perform operations on or with media, sometimes referred to as print media. The media may be paper, cardboard, cardstock, vinyl, latex, or another type of media. In some implementations, the media may be a substrate to receive a three-dimensional (3D) printing substance. In such an implementation, the electronic device 403 may be a 3D printer, or additive manufacturing device.

In some implementations, the electronic device 403 may have a media tray 401, a tray cover 404, and a tray cover extender 400. The media tray 401, tray cover 404, and tray cover extender 400, and any constituent components thereof, may be similar in structure and/or function to like-named elements described above. The media tray 401 may have a media holding portion 412 to receive and hold media for use in the electronic device 403. The media tray 401 may be movable between a first position, wherein the media tray 401 has a first length to accommodate media of a corresponding first length, and a second position, wherein the media tray 401 has a second length to accommodate media of a corresponding second length, longer than the first length. The media tray 401 is illustrated as being disposed in the second position in FIGS. 4A-4B. Further, the media tray is illustrated as being disposed in an opened position with the electronic device 403, wherein the media tray 401 is, at least partially, removed from an input tray bay 414 of the electronic device so that a user may load media into a loading side of the media tray 401. In some implementations, the media tray 401 may be completely removable from the electronic device 403 in the opened position in order to ease loading of media. In other implementations, the media tray 401 may only partially remove from the input tray bay 414.

Figure 4B:
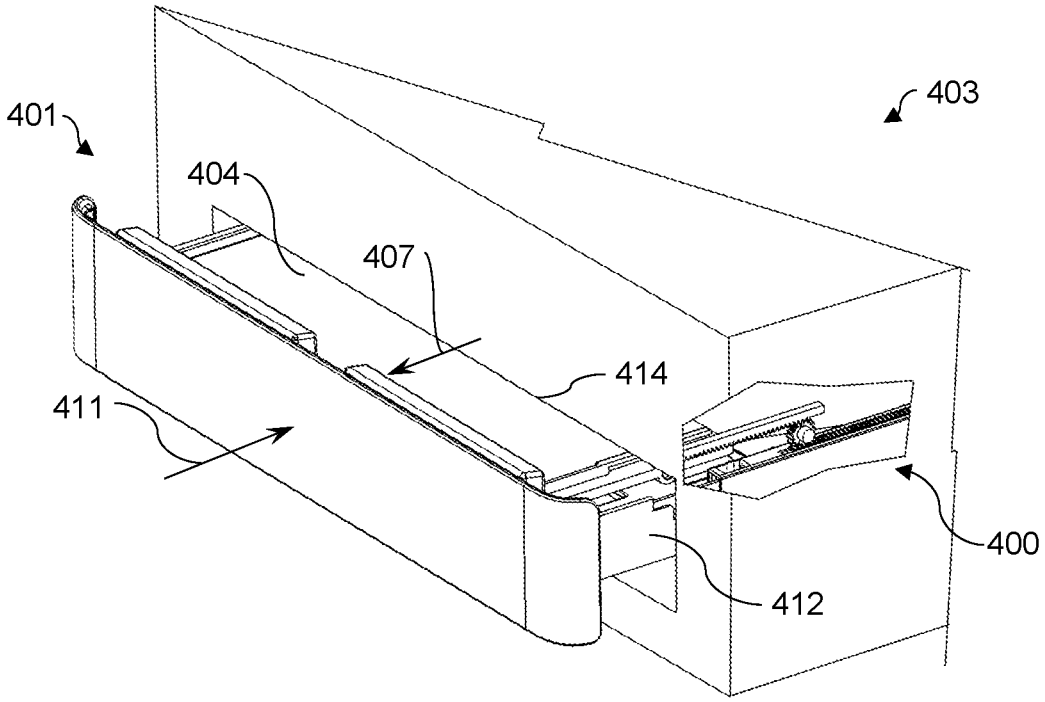
FIG. 4B is a perspective view of an example imaging device having an example tray cover extender.

Referring additionally to FIG. 4B, a perspective view of the example electronic device 403 is illustrated wherein the media tray 401 has been fully loaded along a closing direction 411 into the input tray bay 414 and therefore is disposed in a loaded position within the electronic device 403. As the media tray 401 is moved from the opened position to the loaded position, a tray rack of the tray cover extender 400 is moved past or along a pinion gear to actuate the pinion gear. In turn, the pinion gear actuates a cover rack attached to the tray cover 404 in order to move the tray cover 404 to an extended position, e.g., along direction 407, opposite to the closing direction 411. Thus, as the media tray 401 is fully loaded into the input tray bay 414, the tray cover 404 is to move towards the media tray 401 to fully cover or conceal the loading side of the media tray 401 and protect media within the media tray 401 from the environment.

What is claimed is:

1. A tray cover extender, comprising:

a cover rack attached to a movable tray cover such that a movement of the cover rack is transferred to a movement of the movable tray cover;

a pinion gear operably engaged with the cover rack so as to actuate the cover rack if the pinion gear is actuated; and a tray rack attached to a media tray and to actuate the pinion gear as the media tray is moved past the pinion gear, wherein:

the pinion gear is located between and engaged with the cover rack and the tray rack;

the moveable tray cover is arranged to conceal the media tray while the media tray is disposed in a first position; and the cover rack is to extend the movable tray cover from a retracted position to an extended position to conceal the media tray while the media tray is extended to a second position.

2. The tray cover extender of claim 1, wherein the pinion gear is to move the cover rack in a direction opposite to a closing direction of the media tray if the tray rack actuates the pinion gear.

3. The tray cover extender of claim 2, wherein the cover rack is to move the tray cover from the retracted position to the extended position if the tray rack actuates the pinion gear so as to cause the pinion gear to actuate the cover rack.

4. The tray cover extender of claim 3, wherein the tray cover is to move in a direction opposite to the closing direction of the media tray if the tray cover is moved from the retracted position to the extended position.

5. A media tray, comprising:

a media holding portion movable between a first position and a second position;

a tray cover movable between a retracted position and an extended position; and a tray cover extender, comprising:

a tray rack attached to the media holding portion and movable between a lowered position and a raised position;

a cover rack engaged with the tray cover; and a pinion gear operably engaged with the cover rack, the pinion gear to operably engage with the tray rack if the tray rack is disposed in the raised position, wherein the pinion gear is to actuate the cover rack if the pinion gear is actuated by the tray rack, and wherein the tray rack is to actuate the pinion gear as the media holding portion is moved past the pinion gear if the tray rack is disposed in the raised position.

6. The media tray of claim 5, wherein the tray rack is to move from the lowered position to the raised position if the media holding portion is moved from the first position to the second position.

7. The media tray of claim 6, wherein the media holding portion is sized to hold media of a first length if disposed in the first position, and wherein the media holding portion is sized to hold media of a second length, longer than the first length, if disposed in the second position.

8. The media tray of claim 5, wherein the tray cover is attached to an imaging device and the media holding portion is movable between a loaded position within the imaging device, and an opened position, relative to the tray cover.

9. The media tray of claim 5, wherein the tray cover extender further comprises a cam and a trigger, the trigger to actuate the cam such that the cam pushes on the tray rack in order to transition the tray rack from the lowered position to the raised position.

10. An imaging device, comprising:

a media tray having a media holding portion convertible between first position to accommodate a first media size and second position to accommodate a second media size;

a tray cover to at least partially conceal a loading side of the media holding portion, the tray cover movable between a retracted position, concealing a first portion of the loading side, and an extended position, concealing a second portion of the loading side, larger than the first portion; and a tray cover extender, comprising:

a tray rack attached to the media tray and movable between a lowered position and a raised position;

a cover rack attached to the tray cover such that a movement of the cover rack is transferred into a movement of the tray cover between the retracted position and the extended position; and a pinion gear operably engaged with the cover rack so as to move the cover rack if the pinion gear is actuated, the pinion gear engageable with the tray rack if the tray rack is disposed in the raised position, wherein the tray rack is to actuate the pinion gear if the tray rack is disposed in the raised position and the tray rack is moved past the pinion gear.

11. The imaging device of claim 10, wherein the tray rack is to move past the pinion gear as the media tray is moved from an opened position with the imaging device to a loaded position within the imaging device.

12. The imaging device of claim 11, wherein the tray rack is to transition from the lowered position to the raised position if the media holding portion is moved from the first position to the second position.

13. The imaging device of claim 10, wherein the second media size is longer than the first media size.

14. The imaging device of claim 10, wherein the tray cover extender further comprises a biasing member to transition the tray rack into the lowered position.

15. The imaging device of claim 14, wherein the biasing member is a spring to exert a force on the tray rack to transition the tray rack into the lowered position.

* * * * *